US008240177B2

(12) United States Patent
Baser

(10) Patent No.: US 8,240,177 B2
(45) Date of Patent: Aug. 14, 2012

(54) KEYED LOCK DOOR HANDLE

(76) Inventor: Owen R. Baser, Sacramento, CA (US)

( * ) Notice: Subject to any disclaimer, the term of this patent is extended or adjusted under 35 U.S.C. 154(b) by 521 days.

(21) Appl. No.: 12/465,104

(22) Filed: May 13, 2009

(65) Prior Publication Data

US 2009/0282880 A1 Nov. 19, 2009

Related U.S. Application Data

(60) Provisional application No. 61/052,960, filed on May 13, 2008.

(51) Int. Cl.
*E05B 21/04* (2006.01)

(52) U.S. Cl. ..... 70/224; 70/92; 70/465

(58) Field of Classification Search ..... 70/92, 224, 70/465, DIG. 20; 292/92–94, 336.3, 173, 292/143, 142, 279
See application file for complete search history.

(56) References Cited

U.S. PATENT DOCUMENTS 1,755,434 A * 4/1930 Ellingson ..... 70/476
2,219,740 A * 10/1940 Hillgren ..... 70/150
2,503,192 A * 4/1950 Cerf, Jr. ..... 292/153
4,438,962 A * 3/1984 Soloviff et al. ..... 292/144
4,974,883 A * 12/1990 Jans ..... 292/169
5,259,652 A * 11/1993 Adams et al. ..... 292/169.14
5,460,419 A * 10/1995 Castoldi ..... 292/336.3
RE36,209 E * 5/1999 Walls ..... 292/173
6,536,248 B1 * 3/2003 Fan ..... 70/467
6,860,529 B2 * 3/2005 Chong et al. ..... 292/169.18
7,856,856 B2 * 12/2010 Shvartz ..... 70/107

* cited by examiner

*Primary Examiner* — Suzanne Barrett
*Assistant Examiner* — Ifeolu Adeboyejo
(74) *Attorney, Agent, or Firm* — Ian F. Burns & Associates, P.C.

(57) ABSTRACT

A door handle assembly that can be locked and unlocked using a key. The door handle assembly includes a bolt that is movable from an extended position to a retracted position. The first handle is coupled to the bolt and adapted to cause the bolt to retract when the first handle is pushed. A second handle is coupled to the bolt and adapted to cause the bolt to retract when the second handle is pulled. A key locking mechanism is coupled to the first handle. The key locking mechanism is adapted to selectively prevent the bolt from moving to the retracted position. A safety locking mechanism is coupled to the second handle. The safety locking mechanism is adapted to selectively prevent the bolt from moving to the retracted position.

17 Claims, 7 Drawing Sheets

KEYED LOCK DOOR HANDLE

FIELD OF THE INVENTION

The present invention relates to door handle assemblies. More particularly, the present invention relates to low-profile door handle assemblies having door handles actuated by a non-rotational motion.

BACKGROUND

Conventional door handle assemblies typically include a pair of faceplates, a slide bolt, and a pair of door handles. The slide bolt is assembled inside a standard bore of a door so that when the slide bolt extends, it engages the door to an aperture in a wall thereby closing the door and allowing the door to be locked. The standard bore is covered by two opposing faceplates. The door handles protrude from the faceplates.

The height of a conventional door handle is typically 2.25 to 2.50 inches, as measured from a door surface. A conventional door often damages a wall, especially when a door is slammed into a wall. A wall can also be gradually damaged when a conventional door handle often contacts the wall. To minimize wall damage, people use devices, such as doorstops and rubber pads attached to the walls. However, doorstops and rubber pads are not aesthetically pleasing to some people. Doorstops and rubber pads also require additional cost, time, and effort to install. Additionally, doorstops and rubber pads leave permanent marks or holes on the wall when removed. Thus, a door handle that does not cause wall damage is desired.

SUMMARY OF AT LEAST ONE EMBODIMENT OF THE INVENTION

Advantages of One or More Embodiments of the Present Invention

The various embodiments of the present invention may, but do not necessarily, achieve one or more of the following advantages:

provide a low-profile door handle;

provide a door handle substantially flush with a faceplate cover;

provide an attractive door handle;

provide a door handle assembly that opens a door by a non-rotational motion;

provide a door handle assembly that allows a user to open a door easily;

provide a bolt lockable to prevent opening a door to a room while allowing escape from inside the locked room;

provide a bolt that makes a sturdy and secure door lock;

provide a door handle assembly that is easy to install;

provide a door lock with an emergency access;

the ability to minimize wall damage from a door handle;

provide a door handle that may be operated with minimal force;

provide a door handle that can be easily pushed to open a door;

provide a door lock that can be released by actuating a door handle from the inside of the room; and provide a lock release that can open a locked door when the door handle is moved.

These and other advantages may be realized by reference to the remaining portions of the specification, claims, and abstract.

Brief Description of One Embodiment of the Present Invention

In at least one embodiment, a door handle assembly is provided. The door handle assembly includes a bolt that is movable from an extended position to a retracted position. A first handle is coupled to the bolt and is adapted to cause the bolt to retract when the first handle is pushed. A second handle is coupled to the bolt and is adapted to cause the bolt to retract when the second handle is pulled. A key locking mechanism is coupled to the first handle. The key locking mechanism is adapted to selectively prevent the bolt from moving to the retracted position. A safety locking mechanism is coupled to the second handle. The safety locking mechanism is adapted to selectively prevent the bolt from moving to the retracted position.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
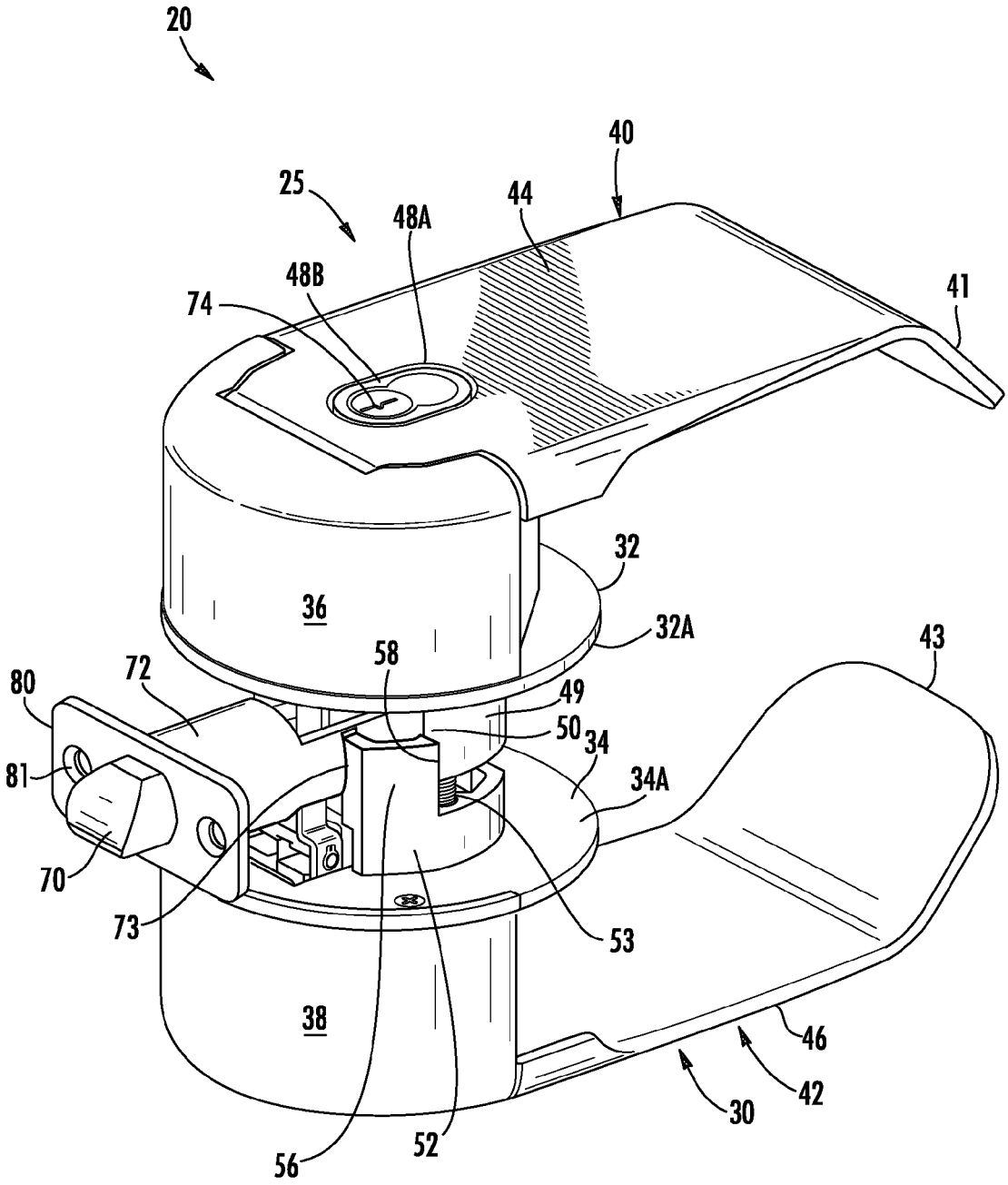
FIG. 1 is substantially a perspective view of one embodiment of the assembled keyed lock door handle in accordance with the present invention.

In the following detailed description of the preferred embodiments, reference is made to the accompanying drawings, which form a part of this application. The drawings show, by way of illustration, specific embodiments in which the invention may be practiced. Reference to inward movement refers to movement of a component from a first position to a position closer to the bolt 70. Likewise, reference to outward movement refers to movement from a second position to a first position spaced further from the bolt 70. It is to be understood that other embodiments may be utilized and structural changes may be made without departing from the scope of the present invention.

The present invention comprises a door handle or door handle mechanism or assembly generally indicated by reference number 20. Door handle assembly 20 can be locked and unlocked on one side using a key and can be locked and unlocked on another side without a key. Door handle assembly 20 is adapted to be mounted to a door (not shown).

Door handle assembly 20 can comprise an outer door handle, 40, an inside door handle 42, a moveable bolt 70, a first or push lever mechanism 22, a second or pull lever mechanism 24, a key locking mechanism 60 and a safety locking mechanism 62.

Figure 2:
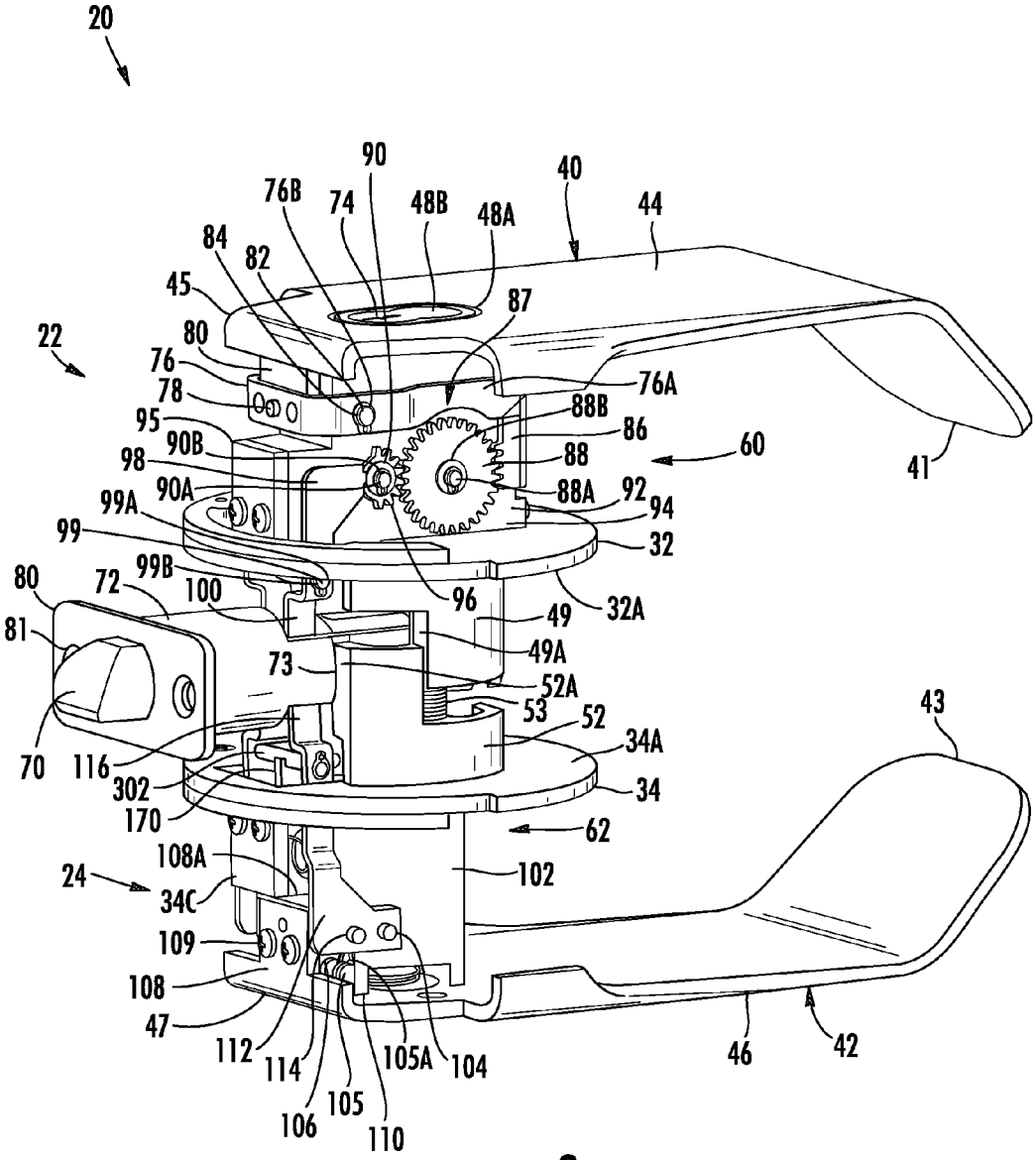
FIG. 2 is a perspective view of the embodiment of FIG. 1 having the faceplate caps removed to illustrate the lever mechanisms.

With reference to FIGS. 1 and 2, door handle assembly 20 can have an outside door handle 40 that is mounted adjacent to the outside surface of a door and an inside door handle 42 that is mounted adjacent to an inside surface of a door. Handles 40 and 42 may have a inward bent ends 41 and 43 respectively which are bent inward toward the door (not shown) to prevent snagging on cords or hoses or the like in case of construction or emergency activities near the handles 40 and 42. Handles 40 and 42 may also have ends 45 and 47, respectively.

Door handle assembly 20 can further include a pair of circular opposing faceplates 32 and 34, a pair of semi-circular opposing faceplate caps 36 and 38 attached to their corresponding faceplates by press fitting. Faceplate cap 36 and handle 40 define a substantially flush and flat surface 44 on front side 28. Faceplate cap 38 and handle 42 define a substantially flush and flat surface 46 on backside 30. Handle 40 has a key access hole 48A for accepting a key mechanism or tumbler assembly 48B. Tumbler assembly 48B can be a conventional tumbler assembly that can be locked and unlocked using a key as is known in the art. A key (not shown) can be inserted into tumbler assembly 48B to lock and unlock handle 20.

Faceplate 32 has a first mount 49 attached to the first inside surface 32A thereof. First mount 49 has a first engaging surface 50. Likewise, faceplate 34 has a second mount 52 attached to the second inside surface 34A thereof. Second mount 52 has a leg 56 having a second engaging surface 58 for engaging the first engaging surface 50 to prevent rotation between the key locking mechanism 60 and the safety locking mechanism 62.

Mounts 49 and 52 are connected to each other by fasteners 53. One fastener 53 extends through faceplate 32, mount 49 and is received into a threaded aperture (not shown) in mount 52. Another fastener 53 extends through faceplate 34, mount 52 and is received into a threaded aperture (not shown) in mount 49. Mounts 49 and 52 extend into a door aperture (not shown). Inside surfaces 32A and 34A are located adjacent the surfaces of the door and fasteners 53 cause the faceplates to be squeezed against the door surfaces.

Handle assembly 20 may further have an elongated bolt 70. Bolt 70 Bolt 70 is preferably configured to be positioned inside a bolt collar 72. A cylindrical bolt collar 72 is configured to attach to a bolt plate 80 which is attached through and aperture to the outside vertical edge of the door (not shown) by using fasteners known in the art, such as a screws in holes 81. Bolt collar 72 has a plurality of slots or notches 73 for engaging the first and second mounts 49 and 52 to hold the bolt collar 72 in non-rotating alignment intermediate the key operating mechanism 60 and the safety operating mechanism 62. First mount 49 has a shoulder or wall 49A that extends into one of slots 73 and second mount 52 has a shoulder or wall 52A that extends into another slot 73.

Referring to FIG. 2, door handle assembly 20 further comprises a key, push or first lever mechanism 22, a safety, pull or second lever mechanism 24, the key operating or key locking mechanism 60 and a safety operating or safety locking mechanism 62.

Key locking mechanism 60 can be controlled by insertion of a key into key hole 74, rotation of tumbler 48B and inward movement of handle 40.

First lever mechanism 22 can include handle 40 having a tab 80 that extends normal from handle 40 toward faceplate 32 at end 45. Tab 80 is attached to a u-shaped front lever or bar 76 by a fastener such as pin or rivet 78 that extends through apertures in front lever 76 and tab 80.

A generally hollow key block or key housing 92 may be attached to faceplate 32 by fasteners (not shown). Front lever 76 has arms 76A that wrap around key block 92. Pivot pin 82 passes through aperture 76B in arms 76A and through an aperture (not shown) in key block 92. Pivot pin 82 is retained by a pair of snap rings 84 located in each end of pivot pin 82.

Front lever or bar 76 pivots about handle pivot pin 82 and is held in place by snap rings 84. Front lever bar arm 76A are further attached to a toothed rack 86 which meshes with idler sprocket or gear 88 which, in turn meshes with bolt gear 90. Handle pivot pin 82 is mounted through key block 92 and engages front lever bar 76 along both the top 94 and bottom 95 sides.

Continuing to refer to FIG. 2, gear assembly 87 can include an idler sprocket 88 and bolt gear 90 rotationally mounted to key block 92. A similar rack 86 and pinion arrangement is configured on both the top 94 and bottom sides of the key block 92.

A gear shaft 88A passes through gear 88 and through an aperture (not shown) in key block 92. Gears 88 and shaft 88A are retained by a pair of snap rings 88B located in each end of gear shaft 88A. Similarly, bolt gear shaft 90A passes through gear 90 and through an aperture (not shown) in key block 92. Gears 90 and shaft 90A are retained by a pair of snap rings 90B located in each end of gear shaft 90A. Gears 88 and 90 can be full round gears or alternatively may be partial gears with half or quarter circle shapes.

Bolt gear 90 has teeth 96 that engage idler sprocket 88 and a bolt lever portion 98 extending inwardly from both the top 94 and bottom sides which are joined at pin 99 and engage bolt 70 at fingers 100. Pin 99 is connected through apertures 99A and retained by snap rings 99B. When handle 40 is pushed, first lever mechanism 22 can cause bolt 70 to retract. The use of gears 88 and 90 allows the bolt to be fully retracted with less motion of handle 40. In one embodiment, the handle may be moved 7/16 of an inch in order to fully retract bolt 70.

Continuing to refer to FIG. 2, second lever mechanism 24 comprises a hollow safety housing or block 102 with pivotally attached pull handle 42 at pivot pin 105. Handle 42 has a tab 108 with u-shaped arms 108A that extend into housing 102. Arms 108A have apertures (not shown). Pivot pin 105 extends through safety block 102 to pivotally support hinge block 106 and is retained by snap rings 105A. Hinge block 106 is attached to handle 42 at safety handle tab 108 by screws 109, rivets or the like.

A pair of safety bolt levers 112 are attached to each side of hinge block 106 by back rivet 104 and front rivet 114. Safety bolt lever 112 is elongated and has safety fingers 116 at one end. Handle 42 can be pulled and pivot off fulcrum point 110 on hinge block 102 causing safety bolt lever 112 to rotate about pivot pin 105, thereby causing safety fingers 116 to engage bolt 70 and urging bolt 70 to retract. When handle 42 is pulled, second lever mechanism 24 can cause bolt 70 to retract.

Figure 3:
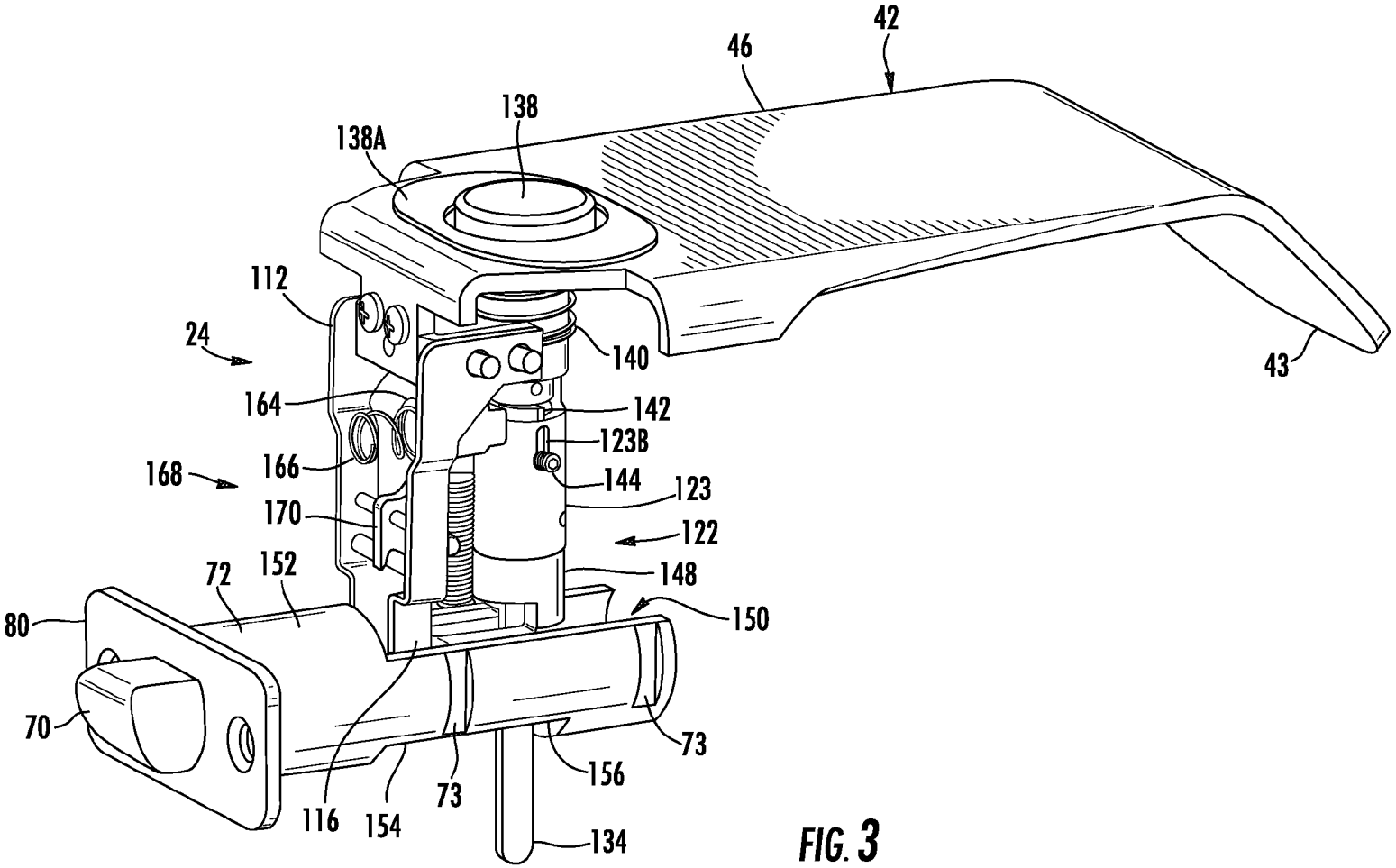
FIG. 3 is a perspective view of a safety locking mechanism showing the operational aspects of the safety locking mechanism.
Figure 4:
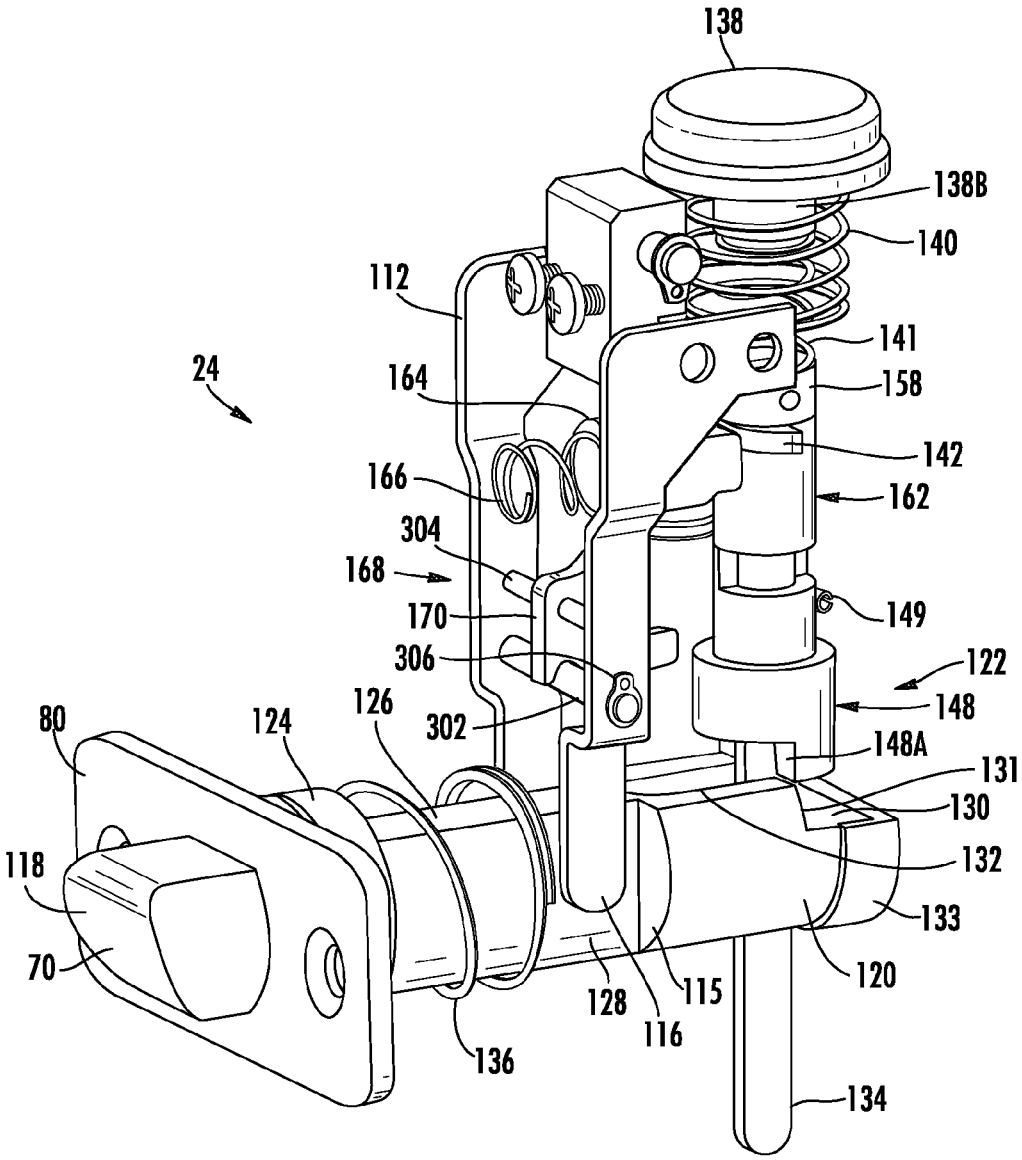
FIG. 4 is an enlarged perspective view of the safety locking mechanism of FIG. 3 with the handle removed.

With reference now to FIGS. 3 and 4, bolt 70 may have a first end 118 for insertion into an opening in a striker plate (not shown) on an opposing door frame as is known in the art. When end 118 is engaged with the striker plate, the door is held in a closed position. Bolt 70 can have a second end 120 for engaging a locking slide 122.

Bolt 70 further comprises a split bolt guide ring 124 through which bolt 70 may slide, a central shaft 126 has material removed on each side notches 128 on each side of bolt 70 for receiving the key fingers 100 and safety fingers 116.

A pair of retraction walls or surfaces 115 are formed on bolt 70 at the base of notches 128. Fingers 100 and 116 engage and press on retraction surface 115 in order to retract bolt 70 out of the striker plate and into bolt collar 72. Alternatively, fingers 100 and 116 could be mounted on the outside of bolt 70.

Bolt collar 72 can have a top opening 150 formed by removing material along the top of the cylindrical body 152 of bolt collar 72 and a bottom opening 154 diametrically opposed to top opening 150 to form a key lock shaft throughway 156 in the bolt collar 72.

A locking notch 130 is formed adjacent end 120 for engaging the locking slide 122. Bolt locking surface 131 faces locking notch 130 and is generally normal to the axis of bolt 70. A bolt end cover 133 is attached to bolt end 120.

An oval shaped shaft slot 132 may be formed intermediate the locking notch 130 and end 120 to provide a passageway for the lock shaft 134 to pass through bolt 70 to engage with locking slide 122. A coil spring 136 surrounds central shaft 126 and is compressed between ring 124 and lever fingers 100 and 116 (FIG. 2). Spring 136 biases bolt 70 toward an extended position as shown in FIGS. 3 and 4.

Figure 6:
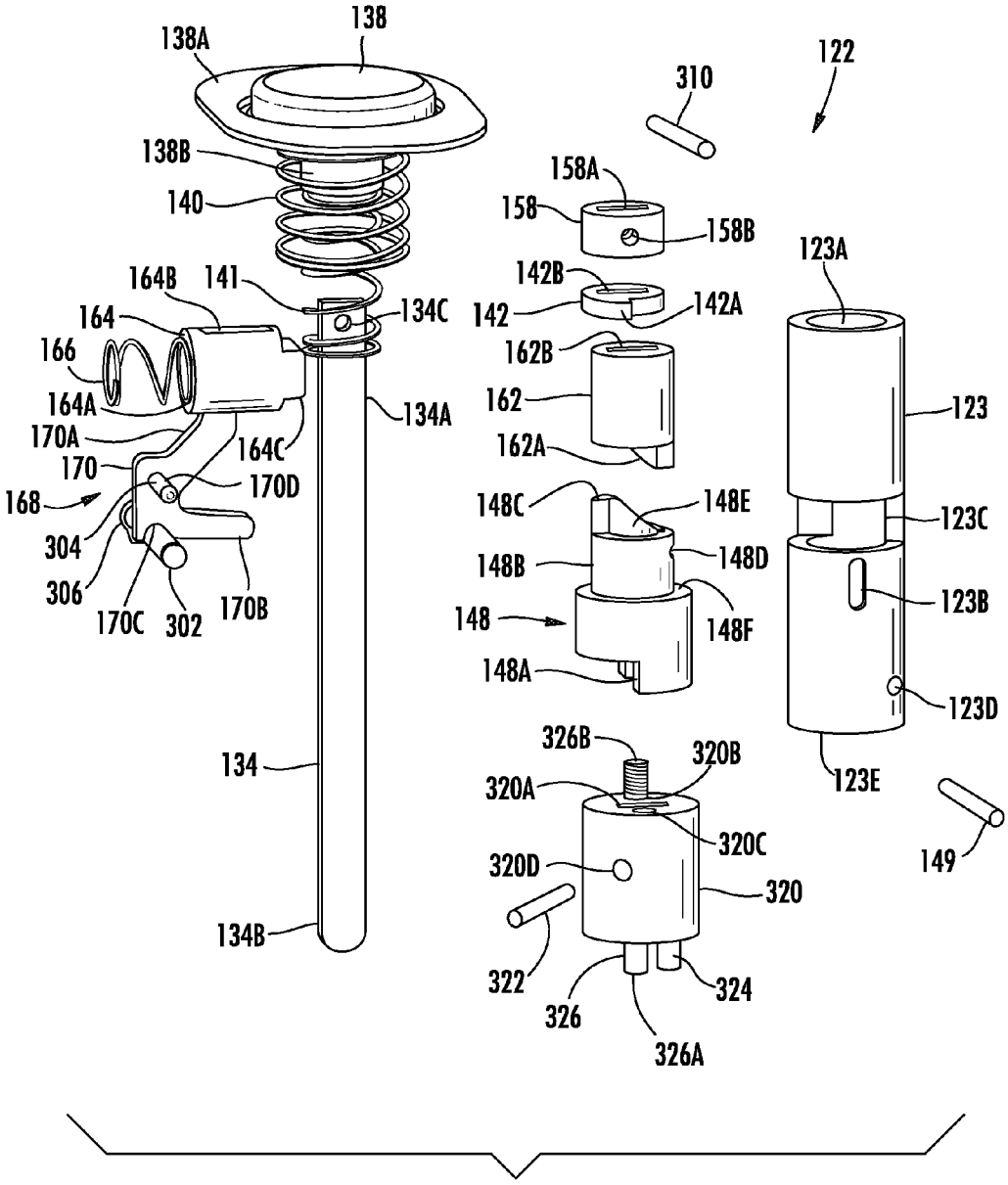
FIG. 6 is a partially exploded view of FIG. 5 with the lock tube.

With reference to FIGS. 3, 4 and 6, safety locking mechanism 62 can include a locking slide 122, push button 138, button spring 140, locking slide bias spring 141 and lock pin assembly 164. Button spring 140 biases button 138 outwardly away from locking slide 122. Button 138 has a projection or boss 138B that extends toward safety block 102. A button cover 138A may surround button 138 and enclose the space between button 138 and handle 42. Bias spring 141 is mounted in an extended position and biases locking slide 122 away from engagement with bolt 70.

Locking slide 122 may comprise a cylindrical lock tube 123 with a central bore 123A, slot 123B, opening or recess 123C, pin aperture 123D and bottom surface 123E.

Locking slide 122 further comprises a cam 142, bolt engagement tube 148, a cam tube 162 and upper tube 158. Cam 142, bolt engagement tube 148, a cam tube 162 and upper tube 158 are all placed in a co-linear side by side arrangement and mounted inside central bore 123A of locking tube 123. Bolt engagement tube 148 extends partially below locking tube 123. Cam 142 resides in recess 123C.

Cam 142 can have a cam surface 142A that extends outwardly from a circumferential edge and a shaft aperture 142B. Bolt engagement tube 148 has a bolt engagement surface 148A, narrow portion 148B, sloping cam surface 148C, recess 148D, bore 148E and bottom end surface 148F. Surface 148F rests in engagement with locking tube surface 123E. Bolt engagement tube 148 is held in locking tube 123 by a press fit pin 149 that extends through hole 123 and into recess 148D.

Cam tube 162 may have a sloping cam surface 162A and aperture 162B. Cam surfaces 148C and 162A mate with a slide upon each other as cam tube 162 is rotated. Upper tube 158 has a shaft aperture 158A and a hole 158B.

Guide screw 144 is threaded into an aperture 144A (FIG. 7) of safety housing 102 and extends into slot 123B. Guide screw 144 prevents rotation of locking tube 123 while allowing locking tube 123 to slide along the axis of locking tube 123.

An elongated blade shaped key lock shaft 134 may have ends 134A, 134B and hole 134C. Key lock Shaft 134 extends into and through bores 148E and apertures 162B, 142B and 158A. Key lock shaft 134 is engaged with cam 162. Rotation of key lock shaft 134 causes cam surface 162A to engage and slide on cam surface 148C urging movement of bolt engagement tube 148 along the axis of locking tube 123 toward bolt 70. Further rotation of key lock shaft 134 causes bolt engagement surface 148A to engage and rest on bolt 70 on locking surface 131. In this position, bolt 70 is prevented from retracting from the extended position.

Figure 7:
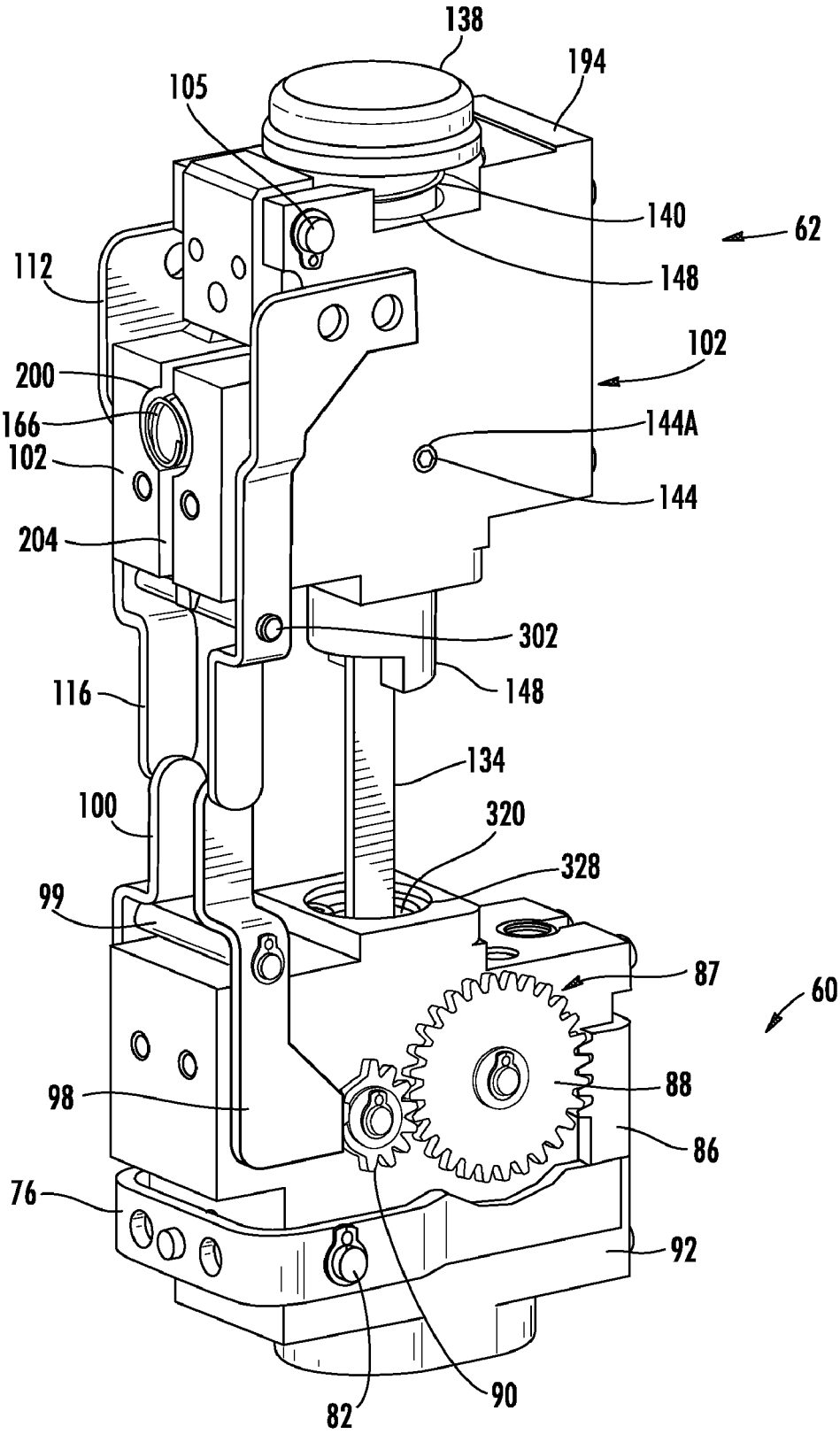
FIG. 7 is an enlarged perspective view of the key and safety locking mechanisms.

Lock pin 164 may have a bore 164A, slot 164B and a narrow shoulder or ridge 164C. Lock pin 164 is slideably mounted in safety housing or block 102. With additional reference now to FIG. 7, safety block 102 has a bore 200 (FIG. 7) and a slot 204 (FIG. 7). Lock pin 164 can slide along bore 200 and move perpendicularly to locking slide 122. Lock pin 164 is biased by spring 166 toward locking slide 122. One end of spring 116 is located in bore 164A and the other end of spring 116 rests against faceplate portion 34C (FIG. 2).

Lock pin 164 can move such that ridge 164C can be engaged by cam surface 142A. Ridge 164C may also extend into channel or recess 123C. Rotation of cam 142 can force lock pin 164A to move out of channel or recess 123C.

A pin puller assembly 168 can connect lock pin 164 and safety lever 112 (FIG. 4). Pin puller assembly 168 may comprise a pull bar 170. Pull bar 170 can have an arm 170A, arm 170B, recess 170C and aperture 170D. Arm 170A extends into and is retained in lock pin slot 164B. Pull bar 170 and arm 170 can move within slot 204 (FIG. 7). Pin 304 extends through pull bar aperture 170D and is attached to the inside surfaces of levers 112. A shaft 302 can be mounted with ends extending though apertures in levers 112. Shaft 302 can be retained to levers 112 by snap rings 306. Shaft 302 may further rest in recess 170C.

When handle 42 is pulled, movement of safety lever 112 causes pull bar 170 to rotate about shaft 302 causing arm 170A to pull lock pin 164 outwardly from channel 123C. This releases locking slide 122 and allows spring 141 to move locking slide 122 to disengage from bolt 70 allowing bolt 70 to move to a retracted position.

Lock pin 164 has a ridge 164C that can be engaged and disengaged with channel 123C of lock tube 123. When lock pin 164 is removed from channel 123C, spring 141 urges bolt engagement tube to move away from the bolt 70 allowing bolt 70 to be moved into a retracted position.

Referring to FIG. 7, safety block 102 has push button 138 extending from the outer surface 194. Spring 140 is adapted to be held in a biased position in bore 198 in safety block 102. Spring 166 may be retained in bore 200 and retained therein by faceplate portion 34C (FIG. 2). Pull bar 170 (FIG. 5) travels back and forth in slot 204 to move lock pin 164 (FIG. 5) within bore 200.

With reference to FIGS. 2, 3 and 6, key locking mechanism 60 can include tumbler assembly 48B, locking slide 122, shaft 134 and key lock tube 320.

Turning specifically to FIG. 6, key lock tube 320 may have rectangular shaped bore 320A and circular bores 320B, 320C and 320D. A pin 324 is mounted in bore 320B and extends outwardly towards and mates with tumbler assembly 48B (FIG. 2). Pin 324 is adapted to be engaged by tumbler assembly 48B for rotary movement.

A fastener such as an Allen head screw 326 can be mounted into bore 320B. Bore 320B can be threaded. Screw 326 can have a hexagonal Allen head end 326A and a threaded end 326B. Threaded end 326B is engaged with and tightens against shaft 134 toward end 134B. In this manner, screw 326 holds shaft 134 in place. Removal of screw 326 from bore 320 allows shaft 134 to be slid out of door handle assembly 20 and allows disassembly of key locking mechanism 60 and safety locking mechanism 62.

Tumbler assembly 48B (FIG. 1) can be removed from hole 48A (FIG. 1) by using a special key (not shown). After tumbler assembly 48B is removed from hole 48A, lock slide 122 can be disassembled by removing screw 326 from key lock tube 320.

Key lock tube 320 can be mounted in bore 328 (FIG. 7) of key lock block or housing 92. Shaft 134 extends through bores 320A, 148E and apertures 162B, 142B, 158A and into spring 141. Pin 322 extends through bore 320D and rests against plate 32 (FIG. 2). Pin 310 can extend through apertures 158B, hole 134C and spring 141 in order to couple spring 141 to shaft 134 and retain shaft 134 to upper tube 158. Pin 310 thereby couples spring 141 to shaft 134.

It is noted that the components of door handle assembly 20 can be formed from a variety of materials such as metals or plastics.

Operation

Turning now to FIGS. 2, 3 and 4, when door handle assembly 20 is unlocked such that locking slide 122 is disengaged from bolt 70, the safety handle 42 may be pulled outwardly causing handle 40 to pivot about pivot pin 105 and thereby causing safety bolt lever 112 and safety fingers 116 to bear against retraction surface 115 causing bolt 70 to retract into bolt collar 72. In this manner, bolt end 118 may be disengaged from the opposing striker plate in the door frame allowing the door to open.

When door handle assembly 20 is unlocked such that locking slide 122 is disengaged from bolt 70, the key handle 40 may be pushed inwardly pivoting about pivot pin 82 and thereby causing lever 76 to move rack 86 and rotate gear 88 turning gear 90 causing bolt lever portion 98 and key fingers 100 to bear against retraction surface 115 causing bolt 70 to retract into bolt collar 72. In this manner, bolt end 118 may be disengaged from the opposing striker plate in the door frame allowing the door to open.

To lock door handle assembly 20 from the inside of the door, button 138 may be depressed inwardly causing projection 138B to abut against lock tube 123 and moving locking slide 122 to move linearly toward the bolt 70 until bolt engagement surface 148A is engaged with and bears against locking surface or face 131. At the same time, channel 123C of lock tube 123 moves into alignment with locking pin 164 such that spring 166 urges shoulder 164C into channel 123C thereby locking or retaining locking slide 122 to be engaged with bolt 70. In this position, bolt end 118 is engaged with opposing striker plate in the door frame and the bolt 70 is prevented from retroacting keeping the door in a closed locked position.

To unlock door handle assembly 20 from the inside of the door, safety handle 42 may be pulled outwardly causing handle 42 to pivot about pin 105 and causing lever 112 to move. As lever 112 moves, pull bar 170 moves such that lock pin 164 is pulled out of engagement with lock tube 123. More specifically, arm 170A (FIG. 6) pulls on lock pin 164 causing shoulder 164C (FIG. 6) to be removed from engagement in channel 123C (FIG. 6). Lock pin 164 is now disengaged from lock tube 123 and locking slide 122. Spring 141 causes locking slide 122 to move away from engagement with bolt 70. Further pulling of door handle 42 now causes safety fingers 116 to engage retraction surface 115 urging bolt 70 to a retracted position within collar 72 wherein the door can be opened. It is noted that when door handle 42 is lifted or pulled, the safety locking mechanism 62 is released.

Figure 5:
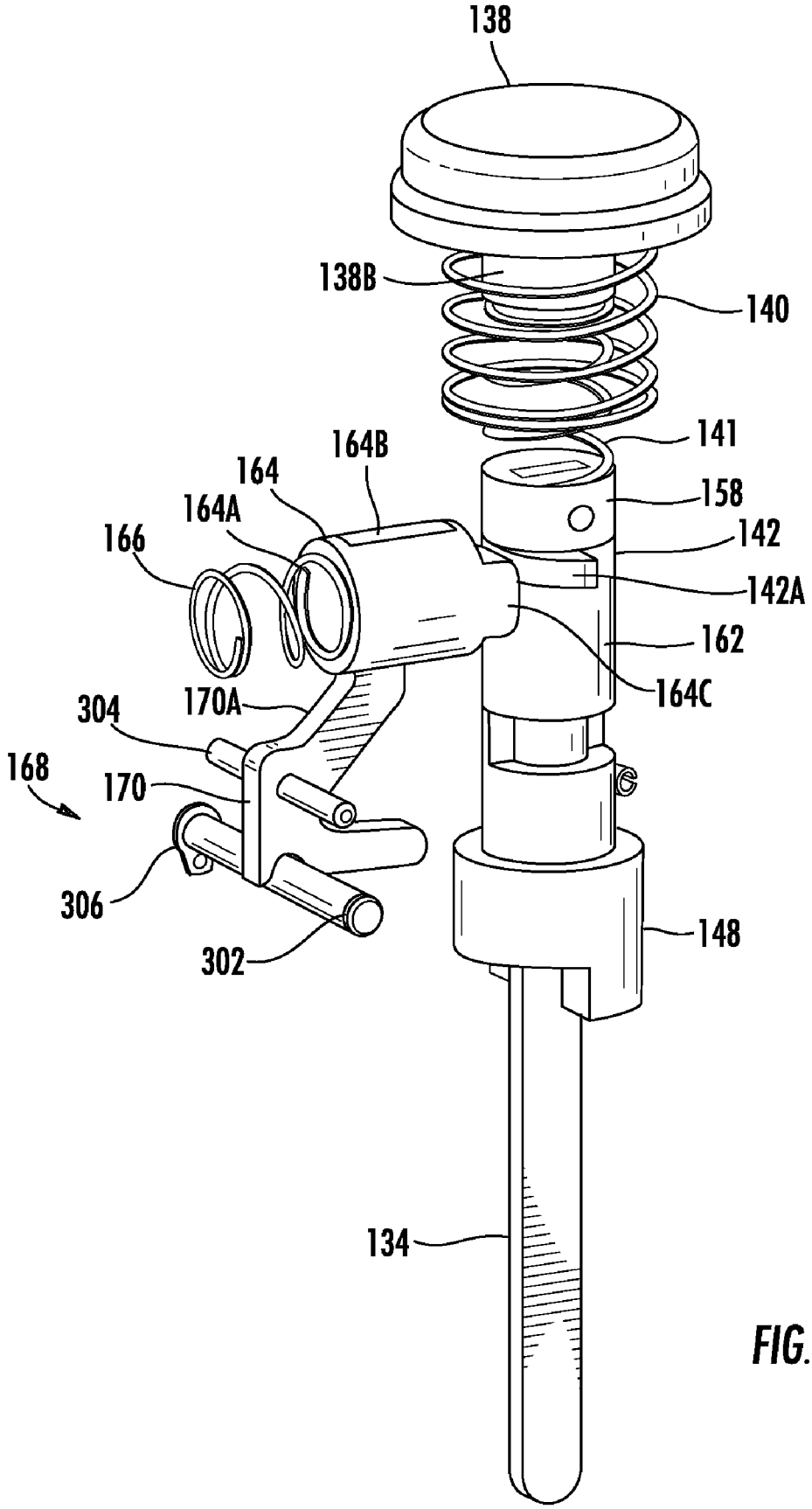
FIG. 5 is a perspective view of a portion of the locking slide.

Door handle assembly 20 may be locked and unlocked from the outside of the door using a key. A key (not shown) may be inserted into tumbler assembly 48A (FIG. 2) and rotated clockwise to lock door assembly 20. Turning to FIGS. 5 and 6, as tumbler assembly 48A is rotated clockwise, pin 324 causes key tube 320 and shaft 134 to rotate clockwise. Rotation of shaft 134 causes cam surface 162A to move on cam surface 148C forcing bolt engagement tube 148 to move away from lock tube 123 linearly toward bolt 70 until the bolt engagement surface 148A is seated against locking surface or face 131 (FIG. 4). At the same time, spring 166 urges lock pin 164 to move within bore 200 (FIG. 7) toward lock tube 123. Lock pin 164 toward lock tube 123 until shoulder 164C is received into channel 123C thereby locking and preventing movement of lock slide 122. Handle 40 is now locked and cannot be moved.

Door assembly 20 may be unlocked by rotating tumbler assembly 48A (FIG. 2) using a key in a counter-clockwise manner. Turning to FIGS. 5 and 6, as tumbler assembly 48A is rotated counter-clockwise, pin 324 causes key tube 320 and shaft 134 to rotate counter-clockwise. Rotation of shaft 134 causes cam 142 to rotate such that cam surface 142A engages shoulder 164C and forces lock pin 164 to move linearly in bore 200 (FIG. 7) away from lock tube 123. When cam 142 is sufficiently rotated, shoulder 164C is forced out of channel 123C of lock tube 123. Spring 141 is now free to pull locking slide 122 linearly away from bolt 70. Spring 141 pulls lock tube 123 and bolt engagement tube 148 upwardly along the axis of shaft 134 until bolt engagement surface 148A is disengaged from locking surface or face 131 (FIG. 4). Handle 40 (FIG. 2) may now be pushed allowing key lever mechanism 22 (FIG. 2) to retract bolt 70 allowing the door to open.

Conclusion

Although the description above contains many specifications, these should not be construed as limiting the scope of the invention but as providing illustrations of some of the embodiments of this invention. Thus, the scope of the invention should be determined by the appended claims and their legal equivalents rather than by the examples given.

What is claimed is:

1. A door handle assembly comprising:

(A) a first handle and a second handle;

(B) a bolt movable from an extended position to a retracted position, the bolt having a retraction surface and a locking surface;

(C) a first lever mechanism coupled between the first handle and the bolt, the first lever mechanism being adapted to engage the retraction surface;

(D) a second lever mechanism coupled between the second handle and the bolt, the second lever mechanism being adapted engage the retraction surface;

(E) a key locking mechanism coupled to the first handle, the key locking mechanism being adapted to selectively engage and disengage the locking surface;

(F) a safety locking mechanism coupled to the second handle, the safety locking mechanism being adapted to selectively engage and disengage the locking surface; and (G) wherein the first lever mechanism comprises: a first lever connected to the first handle, a second lever engagable with the retraction surface and a gear assembly connected between the first and second levers.

2. The assembly of claim 1, wherein the first door handle is depressed to retract the bolt.

3. The assembly of claim 1, wherein the second door handle is pulled to retract the bolt.

4. The assembly of claim 1, wherein the second lever mechanism comprises: a third lever connected to the second handle, the third lever engagable with the retraction surface.

5. The assembly of claim 1, wherein the key locking mechanism comprises: a tumbler assembly mounted to the first lever mechanism, a shaft coupled to the tumbler assembly and a locking slide coupled to the shaft.

6. The assembly of claim 1, wherein the safety locking mechanism comprises: a button coupled to the second handle and a locking slide coupled to the button.

7. A door handle assembly comprising:

(A) a bolt movable from an extended position to a retracted position;

(B) a first handle coupled to the bolt and adapted to cause the bolt to retract when the first handle is pushed;

(C) a second handle coupled to the bolt and adapted to cause the bolt to retract when the second handle is pulled;

(D) a key locking mechanism coupled to the first handle, the key locking mechanism being adapted to selectively prevent the bolt from moving to the retracted position;

(E) a safety locking mechanism coupled to the second handle, the safety locking mechanism being adapted to selectively prevent the bolt from moving to the retracted position; and (F) wherein a push lever mechanism connects the first handle and the bolt and wherein the push lever mechanism comprises: a first lever connected to the first handle; a gear assembly connected to the first lever; and a second lever connected to the gear assembly and adapted to engage the bolt.

8. The assembly of claim 7, wherein a pull lever mechanism connects the second handle and the bolt.

9. The assembly of claim 8, wherein the pull lever mechanism comprises: a third lever connected to the second handle and adapted to engage the bolt.

10. The assembly of claim 7, wherein the key locking mechanism comprises: a tumbler assembly mounted to the first lever; a shaft coupled to the tumbler assembly; and a locking slide coupled to the shaft such that the locking slide engages the bolt as the tumbler assembly rotates.

11. The assembly of claim 10, wherein a lock pin engages the locking slide when the locking slide is engaged with the bolt.

12. The assembly of claim 10, wherein a lock pin is disengaged from contact with the locking slide when the door handle assembly is unlocked.

13. The assembly of claim 7, wherein the safety locking mechanism comprises: a button coupled to the second handle; and a locking slide coupled to the button, such that the locking slide engages the bolt as the button is depressed.

14. A door handle assembly comprising:

(A) a bolt movable from an extended position to a retracted position;

(B) a first handle coupled to the bolt and adapted to cause the bolt to retract when the first handle is moved;

(C) a second handle coupled to the bolt and adapted to cause the bolt to retract when the second handle is moved;

(D) means for allowing the first or the second handle to selectively retract the bolt;

(E) a first locking mechanism mounted to the first handle, the first locking mechanism being adapted to keep the bolt in the extended position, the first locking mechanism including a locking slide, the locking slide being adapted to engage the bolt as the first locking mechanism is actuated; and (F) wherein a lock pin engages the locking slide when the locking slide is engaged with the bolt.

15. The door handle assembly of claim 14, wherein the first locking mechanism further comprises: a tumbler assembly mounted to the first handle; a shaft coupled to the tumbler assembly; and the locking slide coupled to the shaft.

16. The door handle assembly of claim 14, wherein the lock pin is disengaged from contact with the locking slide when the door handle assembly is unlocked.

17. The door handle assembly of claim 14, wherein a second locking mechanism is mounted to the second handle.

* * * * *